US008827512B1

(12) United States Patent
Beadle

(10) Patent No.: US 8,827,512 B1
(45) Date of Patent: Sep. 9, 2014

(54) PATHWAY LIGHT FIXTURE WITH RELEASABLY SEALED LAMP ENCLOSURE

(75) Inventor: Joshua Z. Beadle, San Diego, CA (US)

(73) Assignee: Hunter Industries Incorporated, San Marcos, CA (US)

( * ) Notice: Subject to any disclaimer, the term of this patent is extended or adjusted under 35 U.S.C. 154(b) by 1096 days.

(21) Appl. No.: 12/581,688

(22) Filed: Oct. 19, 2009

Related U.S. Application Data

(60) Provisional application No. 61/106,585, filed on Oct. 19, 2008.

(51) Int. Cl.
*F21V 17/06* (2006.01)

(52) U.S. Cl.
USPC ..... 362/431; 362/153; 362/310; 362/311.02; 362/359

(58) Field of Classification Search
USPC ..... 362/431, 153, 153.1, 310, 311.01, 362/311.02, 311.14, 359, 640, 645, 457, 362/458
See application file for complete search history.

(56) References Cited

U.S. PATENT DOCUMENTS

| | | | | |
|---|---|---|---|---|
| 1,430,354 | A | 9/1922 | Burdick | |
| 1,500,639 | A | 7/1924 | Rekar | |
| 1,880,399 | A | 10/1932 | Benjamin | |
| 3,646,338 | A * | 2/1972 | Goytisolo | 362/294 |
| 4,096,555 | A | 6/1978 | Lasker | |
| 4,321,656 | A * | 3/1982 | Gruver, Jr. | 362/180 |
| 4,464,707 | A | 8/1984 | Forrest | |
| 4,719,548 | A | 1/1988 | Orosz | |
| 4,996,636 | A * | 2/1991 | Lovett | 362/431 |
| 4,999,060 | A | 3/1991 | Szekely et al. | |
| 5,025,358 | A | 6/1991 | Cannell | |
| 5,075,828 | A | 12/1991 | Gordin et al. | |
| 5,154,628 | A | 10/1992 | Skegan | |
| 5,226,721 | A | 7/1993 | Stokes | |
| 5,249,109 | A | 9/1993 | Denison et al. | |
| 5,297,013 | A * | 3/1994 | Hall et al. | 362/363 |
| 5,303,127 | A | 4/1994 | Kosann | |
| 5,459,649 | A | 10/1995 | Ellion | |
| 5,481,443 | A | 1/1996 | Wagner et al. | |
| 5,582,479 | A | 12/1996 | Thomas et al. | |
| 5,718,506 | A | 2/1998 | Yeh | |
| 5,791,768 | A | 8/1998 | Splane, Jr. | |
| 5,908,236 | A | 6/1999 | Lueken et al. | |
| 5,921,663 | A * | 7/1999 | Flammer | 362/294 |
| 6,033,093 | A | 3/2000 | Latsis et al. | |
| 6,082,877 | A * | 7/2000 | Hughes | 362/360 |
| 6,113,433 | A | 9/2000 | Al-Turki | |

(Continued)

*Primary Examiner* — Jong-Suk (James) Lee
*Assistant Examiner* — Leah S Macchiarolo
(74) *Attorney, Agent, or Firm* — Eleanor M. Musick; Procopio, Cory, Hargreaves & Savitch LLP

(57) ABSTRACT

A light fixture for use in low voltage outdoor lighting systems includes a lens assembly with a cylindrical diffuser lens disposed on top of a lens support, and a reflector hood with a crown portion and a flared portion. The lens and reflector hood are attached by means of a resilient ring with an annular channel that fits over the upper edge of the lens. When the lens and ring are pushed into crown portion of the hood, the ring is compressed to create an interference fit that holds the lens within the crown portion. A second resilient ring may be placed over the lower edge of the lens to produce a similar interference fit with the upper portion of the lens support. In one embodiment, a molded plastic hood liner is attached to the inner surface of the hood to provide a reflective surface.

47 Claims, 4 Drawing Sheets

(56) References Cited

U.S. PATENT DOCUMENTS

| | | | | |
|---|---|---|---|---|
| 6,183,112 | B1 * | 2/2001 | Bomas | 362/285 |
| 6,234,649 | B1 | 5/2001 | Katougi | |
| 6,357,892 | B1 | 3/2002 | Beadle | |
| 6,361,193 | B1 | 3/2002 | Gabrius et al. | |
| 6,422,717 | B1 | 7/2002 | Beadle | |
| 6,491,407 | B1 | 12/2002 | Beadle | |
| 6,523,982 | B1 | 2/2003 | Haddad | |
| 6,612,720 | B1 | 9/2003 | Beadle | |
| 6,799,869 | B1 | 10/2004 | Beadle | |
| 6,874,905 | B1 | 4/2005 | Beadle | |
| 7,021,787 | B1 | 4/2006 | Kuelbs | |
| 7,178,952 | B2 * | 2/2007 | Bucher et al. | 362/431 |
| 7,387,409 | B1 | 6/2008 | Beadle | |
| 2008/0084687 | A1 * | 4/2008 | Humphrey | 362/97 |
| 2008/0130304 | A1 * | 6/2008 | Rash et al. | 362/477 |

* cited by examiner

PATHWAY LIGHT FIXTURE WITH RELEASABLY SEALED LAMP ENCLOSURE

RELATED APPLICATIONS

This application claims the priority of U.S. Provisional Application No. 61/106,585, filed Oct. 19, 2008, which is incorporated herein by reference in its entirety.

FIELD OF THE INVENTION

The invention relates to a light fixture for use in low voltage outdoor lighting systems and more specifically to a pathway light fixture with components that are easily removed and replaced.

BACKGROUND OF THE INVENTION

Environmental lighting, particularly outdoor lighting, is well known in commercial or public settings such as parks and schools. Such lighting is also popular in residential applications, both to enhance the appearance and safety of the outdoor area and for security, to illuminate dark areas around a building or in a yard which may provide hiding places and unobserved entry points for intruders.

Landscape and outdoor lighting systems include one or more lighting fixtures which are connected to either a 12 V transformer or a standard 120 VAC line. Some lighting fixtures enclose a halogen lamp or conventional bulb within a housing, and include a reflector assembly and a lens or window within the housing. These fixtures may be used for highlighting features such as trees or statues, i.e., up-lighting or for pathway or ground lighting. Other fixtures, used almost exclusively in down-lighting applications, may have an open aspect, where the reflector, and sometimes the lamp and socket are open and directed toward the ground. These fixtures tend to be used in larger quantities within a lighting system since they are typically less expensive than the closed fixtures and are capable of washing large expanses of open area with glare-free light, e.g., pathways, driveways, patios, ground cover plants, and for perimeter lighting.

Pathway downlighting fixtures typically include a hood or cowl shaped in the form of a bell, half-shell, cone, tulip, or pyramid that surrounds the lamp except for the lower end of the cowl from which the light emanates. In addition to preventing escape of light in an upward direction, the inner surface of the cowl acts as a reflector to optimize the amount of light directed toward the desired target area.

Outdoor light fixtures are prone to dirt build-up and/or corrosion that can diminish light output and accelerate deterioration and, ultimately, failure of the fixture.

An example of a pathway lighting fixture that addresses this problem is provided in U.S. Pat. No. 6,799,869 of Beadle, which is incorporated herein by reference. The fixture has an open face, with the bulb exposed to the elements, while providing a substantially water-tight seal around the base of the bulb and the socket to reduce damage from moisture and dirt intrusion. A collar that lines the inner surface of the fixture's hood performs the seal function at the same time it serves as a light reflector to increase the efficiency of the light output from the bulb. The type of fixture for which the open construction is appropriate generally uses a common low wattage incandescent bulb that generates some heat, but not so much heat that there is a significant fire risk or likelihood of the hot bulb shattering when it becomes wet. The lighting produced by these fixtures is generally quite diffuse. Such a fixture construction would not be appropriate for use with halogen lamps, which produce much higher intensity light, but also create a significant risk of fire if any flammable material comes into contact with the hot lamp. Contamination is also more likely to negatively impact the life of the lamp.

In closed fixtures, the effects of dirt build-up and/or oxidation can be reduced by sealing the lamp within a clear or translucent cylinder to create a moisture-proof chamber. This also removes the risk of physical contact with the bulb. To achieve the desired seal, the upper edge of the cylinder is often permanently attached to the hood using epoxy or silicone adhesive. Any accumulation of material on the cylindrical lens can be easily wiped away to restore full illumination capability. A drawback of the closed fixture design is that one must disassemble the housing by separating the lens from a base portion to access the lamp for replacement. Another issue with closed fixtures is that the lens can break or crack. Since the lens is glued to the hood, the entire hood/lens assembly must be replaced if one wishes to ensure a well-sealed fixture. An exemplary closed fixture is described in U.S. Pat. No. 6,874,905 of Beadle, which patent is incorporated herein by reference. In addition to being costly to replace both the lens and metal hood, introduction of a new hood into an established lighting system can detract from the aesthetics of the system since the new hood will not match the other fixtures because is has not weathered or oxidized, for example, to a verde finish in the case of copper.

The need remains for a pathway light fixture that is attractive, resists breakdown in an outdoor environment, is easy to manufacture and service, and includes easily replaced critical components while still maintaining a good quality seal.

SUMMARY OF THE INVENTION

It is an advantage of the present invention to provide a pathway light fixture having a reflective hood liner that is coupled to the interior of the hood of the pathway light fixture to provide a reflective surface.

Another advantage of the present invention is to provide a pathway light fixture that has a moisture-proof seal to fully enclose the lamp and to protect the lamp and socket against exposure to contaminants.

Still another advantage of the present invention is to provide a light fixture with a moisture-proof seal that can be easily opened and resealed to facilitate lamp and/or lens replacement.

In one aspect of the invention, a light fixture for use in outdoor lighting systems includes a lens assembly with a cylindrical diffuser lens disposed on top of a lens support, and a reflector hood with a crown portion and a flared portion. The lens and reflector hood are attached by means of a resilient ring with an annular channel that fits over the upper edge of the lens. When the lens and ring are pushed into crown portion of the hood, the ring is compressed to create an interference fit that holds the lens within the crown portion. A second resilient ring may be placed over the lower edge of the lens to produce a similar interference fit within the lens support. In one embodiment, a molded plastic hood liner is attached to the inner surface of the hood to provide a reflective surface.

In an exemplary embodiment, the pathway downlight fixture for outdoor installation comprises a post, a socket assembly disposed at the top of the post for retaining a lamp, a lens assembly including a lens support with a recess for receiving a cylindrical diffuser lens disposed on top of the post so that it surrounds the socket assembly, and a hood assembly with an internal recess that is removably attached to the top of the diffuser lens. The diffuser lens has a flexible, resilient silicone ring disposed on at least the upper edge of the lens. The ring has an annular channel that fits closely over the lens edge. The outer diameter of the ring fits closely within the hood recess, which compresses the ring, causing it to form a watertight seal between the upper edge of the lens and the inner surface of the recess.

In order to maximize the effective use of light produced by the lamp, the underside of the hood can be painted or powder coated with a reflective white or light colored finish. This, however, introduces several additional labor intensive steps into the manufacturing process because the rest of the hood must be masked to avoid overspray. To optimize reflectivity with minimal added manufacturing effort, in one embodiment, the hood assembly includes a molded plastic hood liner that is attached to the interior of the hood to provide a reflective surface. In this embodiment, the inner surface of the hood liner is the contact surface for compressing the silicone ring on the upper edge of the lens. In a preferred embodiment, an identical silicone ring is disposed on the bottom edge of the lens, allowing the lens assembly to be easily separated and reassembled to form a waterproof seal.

In another aspect of the invention, the inventive light fixture comprises a cylindrical lens having an upper edge, a lower edge, and an outer diameter; a lens support having an upper portion and a lower portion, the upper portion having a recessed area for retaining the lower edge of the lens, wherein the cylindrical lens and lens support define a lens assembly adapted to partially enclose a lamp and lamp socket; a reflector hood having a crown portion and a flared portion, the crown portion defining a cylindrical recess that has an inner diameter that fits over and encloses the upper edge of the cylindrical lens cylinder; and a resilient ring having an annular channel adapted to fit over and cover the upper edge of the cylindrical lens, the resilient ring having an outer diameter dimensioned to produce an interference fit between the cylindrical lens, the resilient ring and the cylindrical recess within the crown portion when the reflector hood is pressed over the upper edge of the cylindrical lens.

In another aspect of the invention, the pathway downlight fixture for outdoor installation comprises a socket assembly disposed at the top of a mounting structure for retaining a lamp, a lens assembly including a lens support for attaching a cylindrical diffuser lens to the mounting structure so that it surrounds the socket assembly, and a hood assembly that is removably attached to the top of the diffuser lens. The lens has a flexible, resilient silicone ring disposed at one or both edges of the lens. The ring has an annular channel that fits closely over the lens edge. In one embodiment the outer edges of the silicone rings fit within the inner surfaces of the lens support and the hood assembly, compressing the ring and causing it for form a watertight seal between the lens, the lens support and the hood assembly. In another embodiment, the inner edges of the silicone rings fit over the outer surfaces of portions of the lens support and the hood assembly, similarly forming a watertight seal by compression of the silicone ring.

In yet another aspect, the inventive light fixture comprises a reflector hood having a crown portion and a flared portion, the crown portion defining a recess; a cylindrical lens having an upper edge, a lower edge, and an outer diameter that is adapted to be received within the recess; a first resilient ring having an annular channel adapted to fit over and cover the upper edge of the cylindrical lens, the first resilient ring having an outer diameter dimensioned to releasably retain the cylindrical lens within the recess by compressing the first resilient ring within the recess; a lens support having an upper portion and a lower portion, wherein the upper portion has a recessed area for retaining the lower edge of the lens, wherein the cylindrical lens and lens support define a lens assembly adapted to enclose a lamp and lamp socket; and a second resilient ring having an annular channel adapted to fit over and cover the lower edge of the cylindrical lens, the second resilient ring having an outer diameter dimensioned to produce a releasable interference fit between the cylindrical lens, the resilient ring and an inner surface of the recessed area of the lens support.

In still another aspect, the inventive light fixture comprises a reflector hood having a crown portion and a flared portion, the crown portion defining a first recess; a hood liner affixed to a lower surface of the reflector hood, the hood liner having a shape to conform to and closely fit within the lower surface of the reflector hood, the hood liner having a second crown portion that fits within the first recess, the second crown portion defining a second recess; a cylindrical lens having an upper edge, a lower edge, and an outer diameter that is adapted to be received within the second recess; a first resilient ring having an annular channel adapted to fit over and cover the upper edge of the cylindrical lens, the first resilient ring having an outer diameter dimensioned to produce an interference fit between the cylindrical lens, the first resilient ring and an inner surface of the second recess when the reflector hood is pressed over the upper edge of the cylindrical lens; a lens support having an upper portion and a lower portion, the upper portion having a recessed area for retaining the lower edge of the lens, wherein the cylindrical lens and lens support define a lens assembly adapted to enclose a lamp and lamp socket; and a second resilient ring having an annular channel adapted to fit over and cover the lower edge of the cylindrical lens, the second resilient ring having an outer diameter dimensioned to produce an interference fit between the cylindrical lens, the resilient ring and an inner surface of the recessed area of the lens support so that the lower edge of he cylindrical lens is releasably sealed within the lens support. In an alternative embodiment, the hood liner has an annular channel formed therein for receiving the upper edge of the lens and the resilient ring so that compression can be applied to the ring from either or both its outer and inner diameters. The lens support has an extension that fits within the inner diameter of the lens, so that the resilient ring is compressed between the outer surface of the extension and the inner surface of the lens to form a watertight seal.

The separability of the components of the lens/hood assembly permit the lamp to be changed and/or replacement of one or more parts of the assembly without requiring replacement of the entire assembly or fixture. Replacement may be necessitated due to damage to one of the components, or may be desired to give the fixture a different appearance by changing the hood to a different shape, material or finish. In addition, the lens can be replaced if cracked or damaged or if a different color or other optical effect is desired.

BRIEF DESCRIPTION OF THE DRAWINGS

The present invention will be more clearly understood from the following detailed description of the preferred embodiments of the invention and from the attached drawings, in which.

DETAILED DESCRIPTION OF THE PREFERRED EMBODIMENTS

Figure 1:
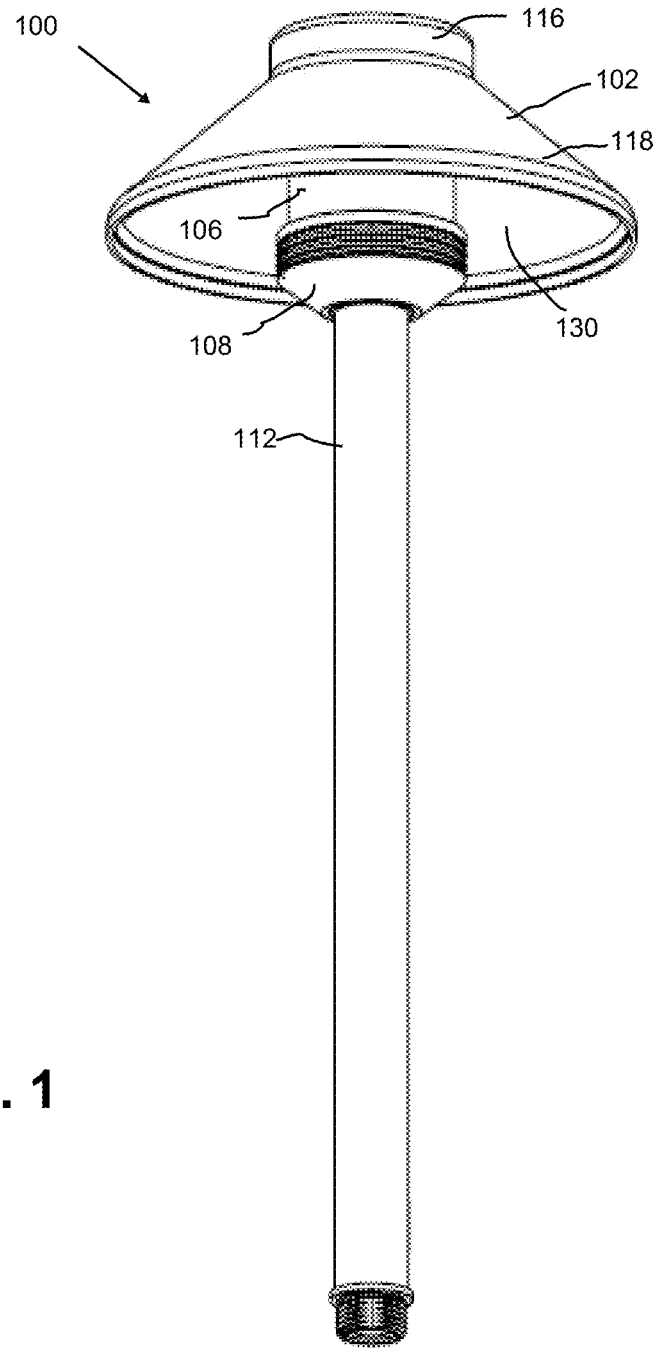
FIG. 1 is an perspective view of a pathway light fixture according to the present invention.
Figure 2:
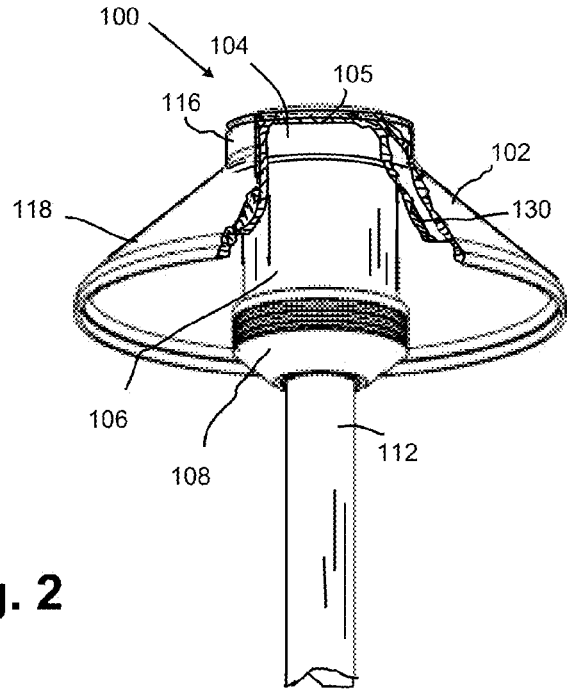
FIG. 2 is a perspective view of the lens assembly with the hood partially cut away.

FIG. 1 illustrates the pathway light fixture 100 with a hood 102, a lens assembly including diffuser lens 106 and lens support 108, and a post 112. Post 112 is shown with a threaded lower end for attachment to a ground spike or mounting bracket (not shown). Wires for connection of the lamp socket (not shown) extend through the hollow post 112 for connection to direct burial cable which is connected to a voltage source. As will be readily apparent to those in the art, alternative support means may be used in place of the post, for example, a bracket for attachment to a wall or other vertical surface may be used.

Reflector hood 102 has a crown portion 116 and a flared portion 118 which extends radially outward and down from the crown portion to capture and reflect downward the light emitted through diffuser lens 106. The crown portion and flared portion are preferably formed integrally from the same piece of metal or plastic, either by molding, stamping or machining. While the short cylindrical crown portion 116 is shown radially centered relative to the circular flared portion, it may also be off-center within a non-circular (oblong or asymmetric) flared portion as may be appropriate for certain lighting projects. Crown portion 116 has a closed flat top to define a recess on its inner surface with an inner diameter that is dimensioned to receive and be supported on top of the upper edge of diffuser lens 106. The height of crown portion 116, i.e., the depth of the recess, is of sufficient dimension to provide good contact around the entire top edge 105 of the lens. An exemplary height range for the crown portion is about 12 mm (~0.25 in.) to 25 mm (~0.5 in.).

Hood 102 is preferably formed from a metal such as copper, brass, aluminum, titanium or stainless steel, with finishes where needed to prevent corrosion or to create a desired aesthetic affect, such as a colored paint, powder coating, or metal plating. Alternatively, high impact, UV resistant plastics or polymers may be used.

Lens 106 is an open cylinder formed from transparent or translucent, e.g., frosted or etched, glass, plastic, polycarbonate or similar material, impact resistant, and capable of withstanding outside environmental conditions without degradation. In the preferred embodiment, glass is used due to its superior ability to tolerate the high temperatures produced by halogen lamps.

Figure 7:
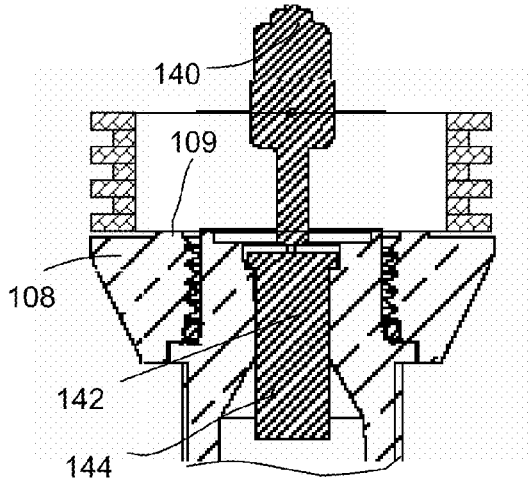
FIG. 7 is a side view, partially cut away, of the lens support.

As shown in more detail in FIG. 7, lens support 108 has a horizontal support surface 109 at the bottom of a cylindrical recess for receiving and supporting the lower edge of the lens 106. The lower portion of the lens support defines the support surface, and has an exterior shape that is generally cylindrical with a beveled edge. Annular channels may be formed in the outer surface for primarily aesthetic reasons, however, such channels can facilitate gripping the lens assembly during disassembly and reassembly of the lighting fixture 100. A concentric bore is formed in the lower portion of the support 108 for attachment to the top of post 112. The bore may be threaded to mate with matching threads on the top of a socket housing 144 which is disposed within the top of the post for supporting the lamp socket 142 and lamp 140. One or more O-rings may be placed between the bore and the socket housing to form a watertight seal. Additional details of the construction of the socket housing 144, lens support 108 and lamp 140, as well as the wiring and post and external connections, are provided in U.S. Pat. No. 6,874,905 of Beadle, which is incorporated herein by reference.

In the preferred embodiment of the present invention, lens support 108 is made from CNC machined brass. Lens support 108 may be made from other metals such as copper, stainless steel, chromed steel, or plastics and may be formed by machining or molding.

An adhesive such as epoxy may also be used to attach lens 106 within lens support 108 for a permanent bond, however, an important advantage of the present invention is the use of silicone rings to provide removable and resealable attachment at both the top and bottom edges of the lens that creates a substantially watertight seal when the fixture is assembled.

Figure 3:
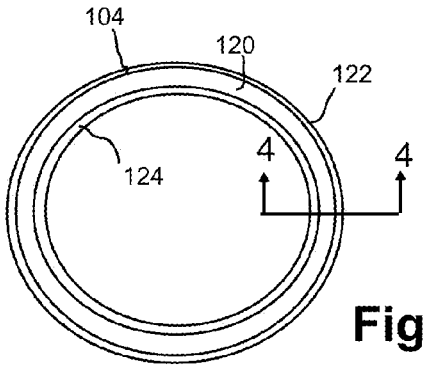
FIG. 3 is a bottom view of a silicone ring for sealing the edge of the lens.
Figure 4:
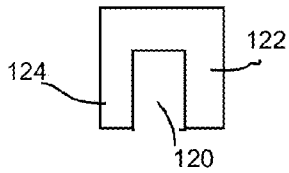
FIG. 4 is a cross-sectional view of the silicone ring taken along line 4-4 of FIG. 3.
Figure 6:
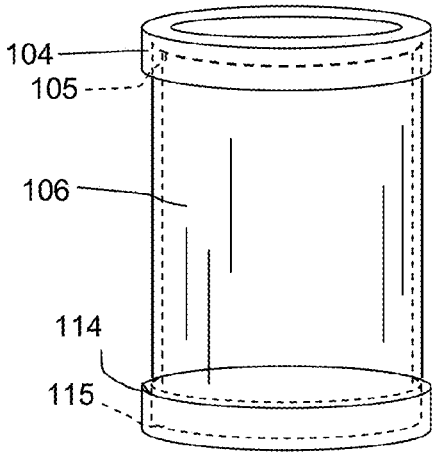
FIG. 6 is a perspective view the diffuser lens with silicone rings disposed on the upper and lower edges.

FIG. 6 illustrates a lens 106 with its upper and lower edges 105 and 115 covered by silicone rings 104 and 114, respectively. The structure of the silicone ring 104 is shown in FIGS. 3 and 4. (Ring 114 will be identical to ring 104.) Ring 104 is a soft, pliable silicone formed to define an U-shaped cross-section with an annular channel 120 that has the same diameter as that of the lens 106, so that it fits closely over the edge of the lens. The diameter may be slightly smaller than that of the lens, in which case the ring will be stretched to fit tightly over the lens edge 105. Inner channel wall 124 and outer channel wall 122 extend a short distance longitudinally along edge of the lens. Typically, the lengths of the channel walls 124 and 124 will be equal to or slightly greater than the height of crown portion 116 of the hood 102, or of the crown portion 132 of hood liner 130 when the hood liner is included. Outer channel wall 122 will have a diameter that is the same or very slightly larger than the inner diameter of the crown portion so that when the edge 105 of the lens with the ring 104 is pushed into the recess defined by the crown portion 116 or 132, the ring 104 is compressed, creating an interference fit between the edge of the lens 105, the ring 104 and the recess sidewalls in the crown portion. The fit should be tight enough to produce firm resistance to separation so that inadvertent separation cannot occur, while still permitting separation upon the application of sufficient separating force by simultaneously rotating and pulling the pieces apart axially. The friction between the surfaces will also prevent inadvertent rotation of the hood and the lens relative to each other.

The silicone material used for the rings 104, 114 should be selected for its tolerance of elevated temperatures and exposure to outdoor elements, including moisture and dirt. It is important that the compressibility and resiliency be retained and that the rings remain soft and pliable after prolonged exposure to the relatively high temperatures produced by halogen and similar lamps so that the rings can still be compressed to produce the important interference fit that holds the components together. Other materials may be used as long as their performance generally matches those of the silicone material. If the rings somehow become damaged or lose their compressibility such that their watertight quality is compromised, they can easily be replaced without requiring replacement of any of the other component of the fixture.

The lower edge 115 of lens 106 is similarly held firmly but separably in place on support surface 109 of lens support 108 by silicone ring 114. The cylindrical portion of the lens support 108 will have an inner diameter that closely fits the outer diameter of ring 114 to create an interference fit between the lower edge 115 of lens 106, the ring 114 and the inner surface of the cylindrical portion of the lens support 108.

Figure 5:
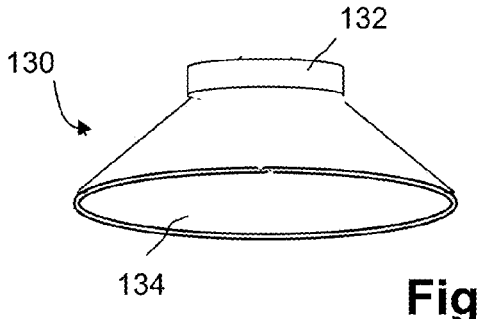
FIG. 5 is a perspective view of the plastic hood liner.

In the preferred embodiment, a hood liner 130, shown in FIG. 5, is attached on the inner surface of the hood 102. The shape of hood liner 130 matches that of hood 102 and includes a crown portion 132, which fits within the recess defined by crown portion 116, and a flared portion 134 that has the same shape and angle as the flared portion 118 of hood 102. The diameter of flared portion 134 should be less than that of flared portion 118 so that the edge of the hood liner 130 will not be visible when viewing the fixture from above. Hood liner 130 may be attached to the inner surface of hood 102 by a durable, moisture- and contaminant-resistant adhesive, such as epoxy. Hood liner 130, which is preferably white or light colored to maximize its reflectivity, will be formed as a single piece from a sturdy molded plastic or polymer, such as polycarbonate. Other attachment means to attach the hood liner to the hood may also include rivets, or releasable fastening means such as screws, interference or snap fits, or other acceptable means to secure the two materials together. When a hood liner is used, the dimensions of the silicone ring 104 and lens 106 will be selected to fit firmly within the recess defined by crown portion 132.

When used for connecting the hood assembly and lens assembly, silicone rings 104 and 114 provide watertight seals that can be removed for maintenance or repair of the fixture, then easily restored to their full watertight quality. No tools are required for assembly or disassembly, yet the components of the fixture are firmly held together in a robust construction.

Figure 8:
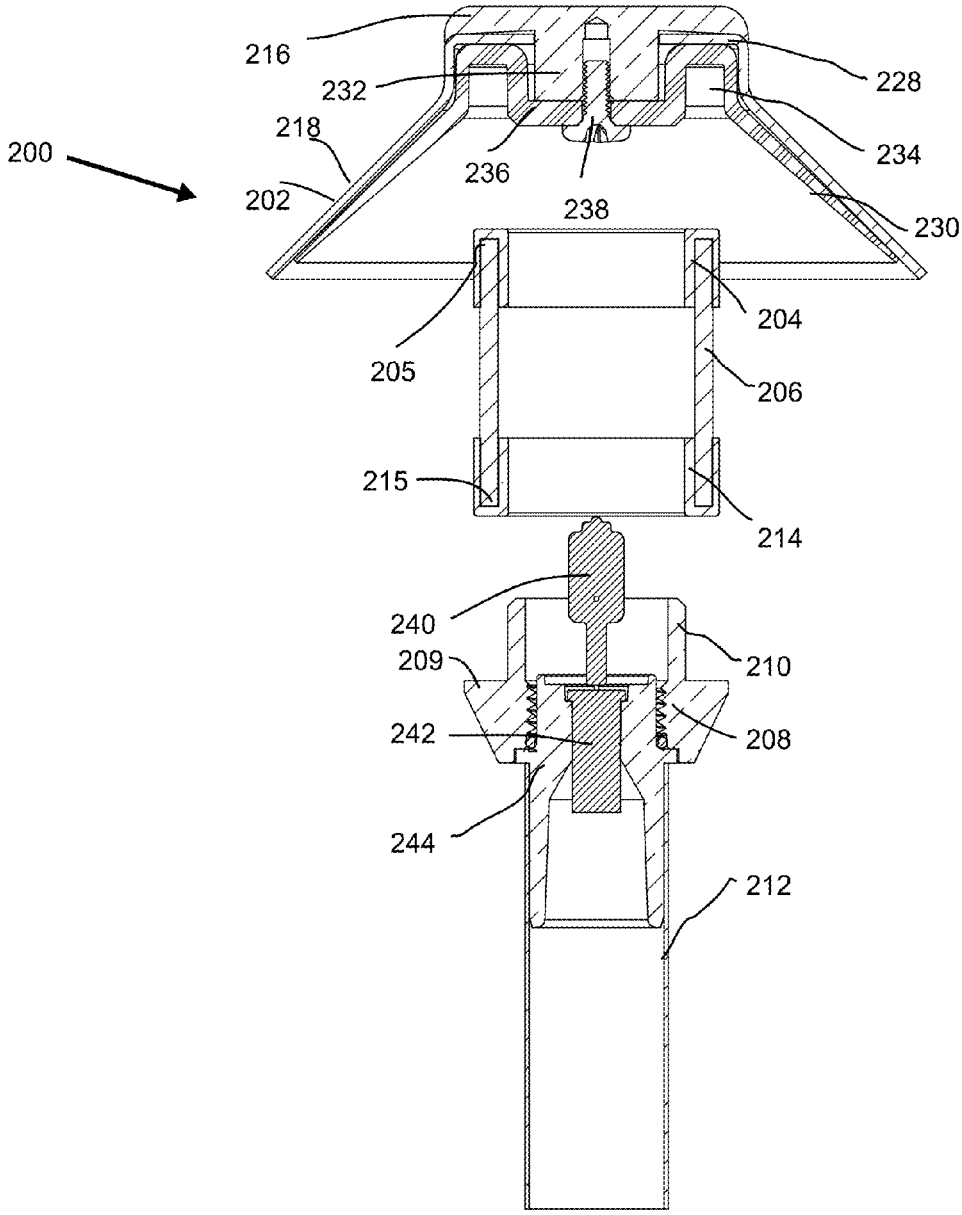
FIG. 8 is a partially exploded cross-sectional side view of an alternative embodiment of the fixture.

An alternative embodiment of the pathway light fixture is illustrated in FIG. 8. As in the preceding embodiments, pathway light fixture 200 includes a hood 202, a lens assembly including diffuser lens 206 and lens support 208, and a post 212 or other appropriate support structure.

Reflector hood 202 has a crown portion 216 and a flared portion 218 that extends radially outward and down from the crown portion to capture and reflect downward the light emitted through diffuser lens 206. The crown portion and flared portion are preferably formed integrally from the same piece of metal or plastic, either by molding, stamping or machining. Crown portion 216 has a closed flat top to define a recess on its inner surface with an inner diameter that is dimensioned to receive and be supported on top of the upper edge of diffuser lens 206. At the center of crown portion 216 is a concentric extension 232 which, together with the inner surface of crown portion 216 defines a channel 228. The channel 228 is of sufficient depth to provide good contact around the entire top edge 205 of the lens.

Hood 202 is preferably formed from a metal such as copper, brass, aluminum, titanium or stainless steel, with finishes where needed to prevent corrosion or to create a desired aesthetic affect, such as a colored paint, powder coating, or metal plating. Alternatively, high impact, UV resistant plastics or polymers may be used.

Lens 206 is an open cylinder formed from transparent or translucent, e.g., frosted or etched, glass, plastic, polycarbonate or similar material, which is impact resistant and capable of withstanding outside environmental conditions without degradation. In the preferred embodiment, glass is used due to its superior ability to tolerate the high temperatures produced by halogen lamps.

Lens support 208 has an upper portion with a cylindrical extension 210 that has a diameter that fits within the inner diameter of lens 206 so that the lens encloses the upper portion of the lens support when the fixture is assembled. The lower portion of lens support 208 defines the support surface 209 and has an exterior shape that is generally cylindrical with a beveled edge. Annular channels may be formed in the outer surface for primarily aesthetic reasons, however, such channels can facilitate gripping the lens assembly during disassembly and reassembly of the lighting fixture 200. A concentric bore is formed in the lower portion of the support 208 for attachment to the top of post 212. The bore may be threaded to mate with matching threads on the top of a socket housing 244 which is disposed within the top of the post 212 for supporting the lamp socket 242 and lamp 240. One or more O-rings may be placed between the bore and the socket housing to form a watertight seat.

In the preferred embodiment, lens support 208 is made from CNC machined brass. Lens support 208 may be made from other metals such as copper, stainless steel, chromed steel, or plastics and may be formed by machining or molding.

Lens 206 has its upper and lower edges 205 and 215 covered by removable silicone rings 204 and 214, respectively. The structure of the silicone rings is that same as that shown in FIGS. 3 and 4. The rings are formed from a soft, pliable silicone to define an U-shaped cross-section with an annular channel that has the same diameter as that of the lens 206, so that it fits closely over the edge of the lens. The diameter may be slightly smaller than that of the lens, in which case the ring will be stretched to fit tightly over the lens edge. Upper ring 204 has an outer diameter that fits tightly within channel 228 if no hood liner 230 is used, or within channel 234 if a hood liner is used, so that when the edge 205 of the lens with the ring 204 is pushed into channel, the ring 204 is compressed, creating an interference fit between the edge of the lens 205, the ring 204 and the sidewalls of the channel (either 228 or 234) in the crown portion. The fit should be tight enough to produce firm resistance to separation so that inadvertent separation cannot occur, while still permitting separation upon the application of sufficient separating force by simultaneously rotating and pulling the pieces apart axially.

At the lower edge 205 of lens 206, ring 215 has inner dimensions selected to fit tightly over cylindrical extension 210 of the upper portion of lens support 208 to create a releasable but waterproof interference fit when the lens and ring are pushed down onto the extension until the ring abuts the upper surface of the support surface 209. In this embodiment, it may be desirable to include a metal or plastic ring (not shown) to cover the outer surface of the resilient ring 214 to reduce the risk of drying or other deterioration of the ring that may occur with exposure to the elements. Such a cover ring may be decorative, for example, formed from a contrasting metal or color, or may include a printed, painted or embossed pattern.

As in the previous embodiments, a hood liner 230 is preferably attached on the inner surface of the hood 202. The profile of hood liner 230 matches that of hood 202 and includes a crown portion that fits within the recess defined by crown portion 216, and a flared portion that has the same shape and angle as the flared portion 218 of hood 202. The crown portion of hood liner 230 includes an concentric extension 236 which has a hollow portion that is dimensioned to receive extension 232 of the hood on its upper surface and to define a channel 234 for receiving the top edge of lens 206. Both extensions 232 and 236 may have a concentric bore for receiving a fastener to hold the two parts together. A screw 238 is shown, but other types of fasteners, releasable or permanent, may be used. Alternatively or in addition, hood liner 230 may be attached to the inner surface of hood 202 by a durable, moisture- and contaminant-resistant adhesive, such as epoxy. Hood liner 230, which is preferably white or light colored to maximize its reflectivity, will be formed as a single piece from a sturdy molded plastic or polymer, such as polycarbonate. When a hood liner is used, the dimensions of the silicone ring 204 and lens 206 will be selected to fit firmly within channel 234 that is defined by the crown portion of the hood liner and its corresponding concentric extension 236.

The lighting fixture of the present invention is easy to assemble or disassemble, for the most part, without requiring tools, yet provides a watertight enclosure for protecting the lamp, socket and electrical connections from contamination and corrosion due to exposure to the elements.

The foregoing description of preferred embodiments is not intended to be limited to the specific details disclosed herein. Rather, the present invention extends to all functionally equivalent structures, methods and uses as fall within the scope of the appended claims.

What is claimed is:

1. A light fixture, comprising:

a cylindrical lens having an upper edge, a lower edge, and an outer diameter;

a lens support having a support surface for supporting the lower edge of the lens;

a reflector hood having a crown portion and a flared portion, the crown portion defining a recess that has a diameter and an inner sidewall that fits over and encloses the upper edge of the cylindrical lens cylinder; and an annular channel formed from a resilient material having a U-shaped cross-section with an inner channel wall and an outer channel wall extending from a base portion to fit over and cover the upper edge of the cylindrical lens, wherein the outer channel wall is adapted to be compressed to produce a releasable and resealable interference fit between the cylindrical lens and the inner sidewall of the hood recess to releasably attach and seal the cylindrical lens to the reflector hood.

2. The light fixture of claim 1, further comprising a hood liner having a shape to closely fit within the interior of the reflector hood and between the annular channel on the upper edge of the cylindrical lens and the recess of the reflector hood, wherein the hood liner comprises a reflective surface.

3. The light fixture of claim 2, wherein the hood liner is molded from a thermoplastic polymer.

4. The light fixture claim 2, wherein the hood liner is attached to the interior of the reflector hood by an adhesive.

5. The light fixture of claim 2, wherein the hood liner is attached to the interior of the hood by a releasable fastening means.

6. The light fixture of claim 2, wherein the hood liner has a crown portion with a channel for receiving the upper edge of the cylindrical lens and the annular channel.

7. The light fixture of claim 1, wherein the recess in the crown portion comprises an annular channel dimensioned to receive the annular channel and the upper edge of the cylindrical lens.

8. The light fixture of claim 1, wherein the cylindrical lens is retained on the lens support by a second annular channel formed from a resilient material having a U-shaped cross-section with an inner channel wall and an outer channel wall extending from a base portion that fits over the lower edge of the cylindrical lens wherein one of the inner channel wall and the outer channel wall of the second annular channel is adapted to be compressed to produce a releasable and resealable interference fit between the lower edge of the cylindrical lens and a sidewall of an upper portion of the lens support to releasably attach and seal the cylindrical lens to the lens support.

9. The light fixture of claim 8, wherein the upper portion of the lens support encloses the lower edge of the cylindrical lens.

10. The light fixture of claim 8, wherein the cylindrical lens encloses the upper portion of the lens support.

11. The light fixture of claim 1, wherein the reflector hood is formed from copper.

12. The light fixture of claim 1, wherein the reflector hood is formed from powder-coated or plated metal.

13. A light fixture, comprising:

a reflector hood having a crown portion and a flared portion, the crown portion defining a first recess;

a hood liner affixed to a lower surface of the reflector hood, the hood liner having a shape to conform to and closely fit within the lower surface of the reflector hood, the hood liner having a second crown portion that fits within the first recess, the second crown portion defining a second recess with an inner sidewall;

a cylindrical lens having an upper edge, a lower edge, and an outer diameter that is adapted to be received within the second recess;

a first annular channel formed from a resilient material having a U-shaped cross-section with a first inner channel wall and a first outer channel wall extending from a first base portion to fit over and cover the upper edge of the cylindrical lens, wherein the first outer channel wall is adapted to be compressed to produce a releasable and resealable interference fit between the cylindrical lens and the inner sidewall of the second recess to releasably attach and seal the cylindrical lens to the hood liner a lens support having an upper portion and a lower portion, the lower portion defining a support surface for supporting the lower edge of the lens; and a second annular channel formed from a resilient material having a U-shaped cross-section with a second inner channel wall and a second outer channel wall extending from a second base portion to fit over and cover the lower edge of the cylindrical lens, wherein one of the second inner channel wall and the second outer channel wall is adapted to be compressed to produce a releasable and resealable interference fit between the cylindrical lens and a sidewall of the upper portion of the lens support so that the lower edge of the cylindrical lens is releasably attached and sealed to the lens support.

14. The light fixture of claim 13, wherein the hood liner is molded from a thermoplastic polymer.

15. The light fixture of claim 14, wherein the hood liner is attached to the lower surface of the reflector hood by an adhesive.

16. The light fixture of claim 14, wherein the hood liner is releasably attached to the lower surface of the reflector hood by a releasable fastening means.

17. The light fixture of claim 14, wherein the recess in the reflector hood comprises a channel.

18. The light fixture of claim 13, wherein the upper portion of the lens support encloses the lower edge of the cylindrical lens.

19. The light fixture of claim 13, wherein the cylindrical lens encloses the upper portion of the lens support.

20. The light fixture of claim 13, wherein the reflector hood is formed from copper.

21. The light fixture of claim 13, wherein the reflector hood is formed from powder-coated or plated metal.

22. A light fixture, comprising:

a reflector hood having a crown portion and a flared portion, the crown portion defining a recess;

a cylindrical lens having an upper edge, a lower edge, and an outer diameter that is adapted to be received within the recess;

a first annular channel formed from a resilient material having a U-shaped cross-section with a first inner channel wall and a first outer channel wall extending from a first base portion to fit over and cover the upper edge of the cylindrical lens, wherein the first outer channel wall is adapted to be compressed between an outer surface of the cylindrical lens and an inner sidewall of the recess to releasably and resealably attach and seal the cylindrical lens within the recess;

a lens support having an upper portion and a support surface for supporting the lower edge of the lens; and a second annular channel formed from a resilient material having a U-shaped cross-section with a second inner channel wall and a second outer channel wall extending from a second base portion to fit over and cover the lower edge of the cylindrical lens, wherein one of the second inner channel wall and the second outer channel wall is adapted to be compressed to produce a releasable and resealable interference fit between the cylindrical lens, and the upper portion of the lens support a second annular channel formed from a resilient material having a U-shaped cross-section with a second inner channel wall and a second outer channel wall extending from a second base portion to fit over and cover the lower edge of the cylindrical lens, wherein one of the second inner channel wall and the second outer channel wall is adapted to be compressed to produce a releasable and resealable interference fit between the cylindrical lens and a sidewall of the upper portion of the lens support so that the lower edge of the cylindrical lens is releasably attached and sealed to the lens support.

23. The light fixture of claim 22, further comprising a hood liner attached to a lower surface of the reflector hood, the hood liner having a shape to conform to and closely fit within the lower surface of the reflector hood, the hood liner having a second crown portion that fits within the recess of the reflector hood, the second crown portion defining a second recess which cooperates with the first annular channel to produce an interference fit between the cylindrical lens and the hood liner.

24. The light fixture of claim 23, wherein the hood liner is molded from a thermoplastic polymer.

25. The light fixture of claim 23, wherein the hood liner is attached to the lower surface of the reflector hood by an adhesive.

26. The light fixture of claim 23, wherein the hood liner is attached to the lower surface of the reflector hood by a releasable fastening means.

27. The light fixture of claim 22, wherein the recess in the reflector hood comprises a channel.

28. The light fixture of claim 22, wherein the upper portion of the lens support encloses the lower edge of the cylindrical lens.

29. The light fixture of claim 22 wherein the cylindrical lens encloses the upper portion of the lens support.

30. The light fixture of claim 22, wherein the reflector hood is formed from copper.

31. The light fixture of claim 22, wherein the reflector hood is formed from powder-coated or plated metal.

32. A light fixture, comprising:

a cylindrical lens having an upper edge, a lower edge, an inner diameter, and an outer diameter;

a lens support having a support surface for supporting the lower edge of the lens;

a reflector hood having a crown portion and a flared portion, the crown portion defining an interior recess for receiving the upper edge of the lens, the crown portion including a an annular channel formed from a resilient material having a U-shaped cross-section with an inner channel wall and an outer channel wall extending from a base portion adapted to removably and replaceably fit over and cover the upper edge of the cylindrical lens, the resilient ring having an inner diameter dimensioned wherein the inner channel wall is adapted to be compressed to produce a releasable and resealable interference fit between the cylindrical lens and an outer sidewall of the cylindrical extension of the crown portion to releasable attach and seal the cylindrical lens to the reflector hood.

33. The light fixture of claim 32, further comprising a hood liner having a shape to closely fit within the interior of the reflector hood wherein the hood liner comprises a reflective surface.

34. The light fixture of claim 33, wherein the hood liner is molded from a thermoplastic polymer.

35. The light fixture claim 33, wherein the hood liner is attached to the interior of the reflector hood by an adhesive.

36. The light fixture of claim 33, wherein the hood liner is attached to the interior of the hood by a releasable fastening means.

37. The light fixture of claim 32, wherein the cylindrical lens is retained on the lens support by a second annular channel formed from a resilient material having a U-shaped cross-section with an inner channel wall and an outer channel wall extending from a base portion that fits over the lower edge of the cylindrical lens wherein one of the inner channel wall and the outer channel wall of the second annular channel is adapted to be compressed to produce a releasable and resealable interference fit between the lower edge of the cylindrical lens and a sidewall of an upper portion of the lens support to releasably attach and seal the cylindrical lens to the lens support.

38. The light fixture of claim 37, wherein the upper portion of the lens support encloses the lower edge of the cylindrical lens.

39. The light fixture of claim 37, wherein the cylindrical lens encloses the upper portion of the lens support.

40. The light fixture of claim 32, wherein the reflector hood is formed from copper.

41. The light fixture of claim 32, wherein the reflector hood is formed from powder-coated or plated metal.

42. A light fixture, comprising:

a cylindrical lens having an upper edge and a lower edge;

a lens support having a support surface for supporting the lower edge of the lens;

a reflector hood having a flared portion and a crown portion with an inner sidewall that encloses the upper edge of the cylindrical lens; and a resilient ring having an annular channel formed from a resilient material having a U-shaped cross-section with an inner channel wall and an outer channel wall extending from a base portion to fit over and cover the upper edge of the cylindrical lens, wherein one of the inner channel wall and the outer channel wall is adapted to be compressed to produce a releasable and resealable interference fit between the cylindrical lens, and the crown portion to releasably attach and seal the cylindrical lens to the reflector hood.

43. The light fixture of claim 42, wherein the cylindrical lens is retained on the lens support by a second annular channel formed from a resilient material having a U-shaped cross-section with an inner channel wall and an outer channel wall extending from a base portion that fits over the lower edge of the cylindrical lens wherein one of the inner channel wall and the outer channel wall of the second annular channel is adapted to be compressed to produce a releasable and resealable interference fit between the lower edge of the cylindrical lens and a sidewall of an upper portion of the lens support to releasably attach and seal the cylindrical lens to the lens support.

44. The light fixture of claim 43, wherein the upper portion of the lens support encloses the lower edge of the cylindrical lens.

45. The light fixture of claim 43, wherein the cylindrical lens encloses the upper portion of the lens support.

46. The light fixture of claim 42, wherein the interference fit is created between the upper edge of the lens, the resilient ring and the inner sidewall of the crown portion.

47. The light fixture of claim 42, wherein the crown portion has a cylindrical extension extending downward therefrom, the extension having a diameter adapted to fit within the lens, wherein the interference fit is created by compressing the inner channel sidewall between the cylindrical extension and the upper edge of the lens.

* * * * *

UNITED STATES PATENT AND TRADEMARK OFFICE

CERTIFICATE OF CORRECTION

PATENT NO. : 8,827,512 B1
APPLICATION NO. : 12/581688
DATED : September 9, 2014
INVENTOR(S) : Joshua Z. Beadle It is certified that error appears in the above-identified patent and that said Letters Patent is hereby corrected as shown below:

In the Claims

At Column 11, delete lines 7-15 reading: "a second annular channel formed from a resilient material having a U-shaped cross-section with a second inner channel wall and a second outer channel wall extending from a second base portion to fit over and cover the lower edge of the cylindrical lens, wherein one of the second inner channel wall and the second outer channel wall is adapted to be compressed to produce a releasable and resealable interference fit between the cylindrical lens and the upper portion of the lens support."

Signed and Sealed this
Sixteenth Day of December, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,827,512 B1
APPLICATION NO. : 12/581688
DATED : September 9, 2014
INVENTOR(S) : Joshua Z. Beadle It is certified that error appears in the above-identified patent and that said Letters Patent is hereby corrected as shown below:

In the Specification

In column 2 at line 25, Change “is has” to --it is--.

In column 4 at line 34 (approx.), Change “he” to --the--.

In the Claims

In column 9 at line 37, In Claim 4, after “fixture” insert --of--.

In column 11 at line 63, In Claim 32, after “a” insert --concentric cylindrical extension that extends into the inner diameter of the lens; and--.

In column 11 at line 67, In Claim 32, change “adapted to” to --to--.

In column 12 at lines 1-2, In Claim 32, after “lens,” delete “the resilient ring having an inner diameter dimensioned”.

In column 12 at line 6 (approx.), In Claim 32, change “releasable” to --releasably--.

In column 12 at line 14 (approx.), In Claim 35, after “fixture” insert --of--.

In column 12 at line 56, In Claim 42, change “lens,” to --lens--.

Signed and Sealed this
Seventh Day of April, 2015

Michelle K. Lee

Michelle K. Lee
*Director of the United States Patent and Trademark Office*